United States Patent [19]

Hendrischk

[11] Patent Number: 4,929,103

[45] Date of Patent: May 29, 1990

[54] SHIFTABLE GUIDE FOR A MATRIX PRINTHEAD

[75] Inventor: Wolfgang Hendrischk, Neu-Ulm, Fed. Rep. of Germany

[73] Assignee: Mannesmann AG, Duesseldorf, Fed. Rep. of Germany

[21] Appl. No.: 309,986

[22] Filed: Feb. 10, 1989

Related U.S. Application Data

[63] Continuation of Ser. No. 107,888, Oct. 13, 1987, abandoned, which is a continuation of Ser. No. 317,130, Nov. 2, 1981, abandoned.

[30] Foreign Application Priority Data

Nov. 6, 1980 [DE] Fed. Rep. of Germany ..... 3041877

[51] Int. Cl.[5] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,392,814 | 7/1968 | Rasmussen | 400/693 X |
| 3,759,359 | 9/1973 | Stellmach | 400/124 |
| 3,900,094 | 8/1975 | Larsen | 101/93.05 X |
| 4,010,835 | 3/1977 | Martin et al. | 400/124 |
| 4,086,997 | 5/1978 | Wu | 400/124 X |
| 4,256,408 | 3/1981 | Shelton | 400/124 |
| 4,278,359 | 7/1981 | Weikel | 400/303 |
| 4,459,051 | 7/1984 | Kawai | 101/93.05 X |

FOREIGN PATENT DOCUMENTS

| | | | |
|---|---|---|---|
| 2535699 | 3/1977 | Fed. Rep. of Germany | 400/124 |

*Primary Examiner*—David A. Wiecking
*Attorney, Agent, or Firm*—Ralf H. Siegemund

[57] ABSTRACT

A printhead for dot matrix printing has several styli arranged in one or two vertical columns so that the tips are arranged in one or two mouthpieces being independently movable. High-speed printing operates with a matrix per character having a number of horizontal line positions and as many vertical print positions as there are styli in a column. High-quality printing involves increasing the resolution in both directions, the number of horizontal positions possibly exceeding the number of vertical positions (the latter being an integral multiple larger than one of the numbers of styli in one column). Various structures are disclosed to shift one or two such mouthpieces in vertical direction.

5 Claims, 6 Drawing Sheets

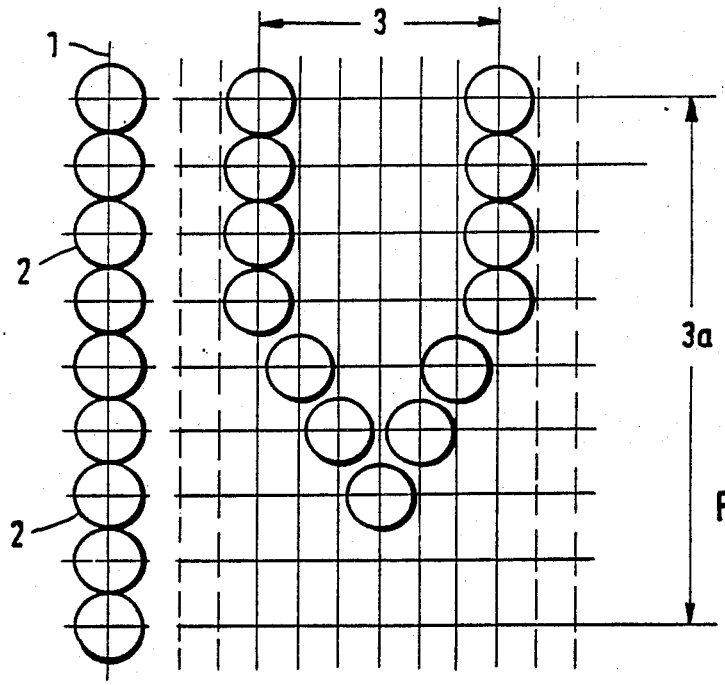
Fig.1
Fig.2
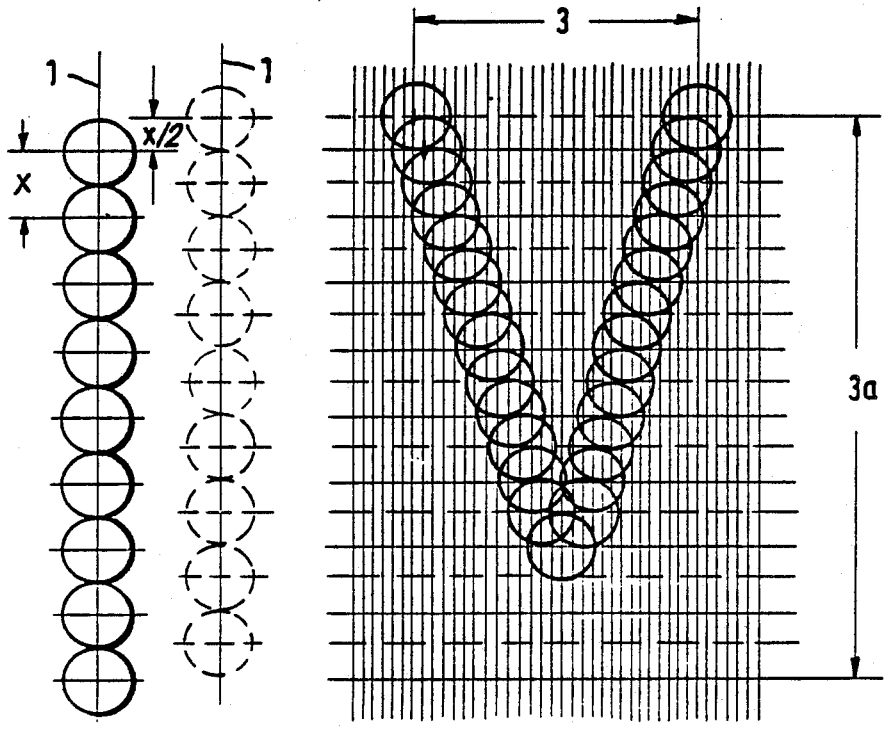

Fig.3
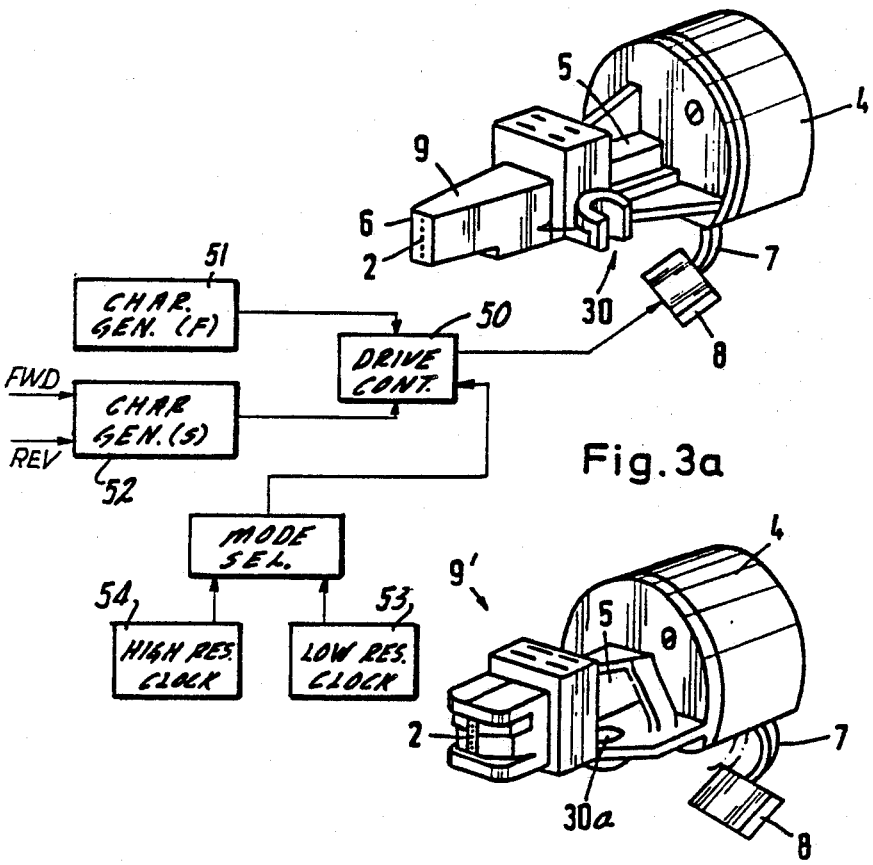
Fig.3a
Fig. 3b
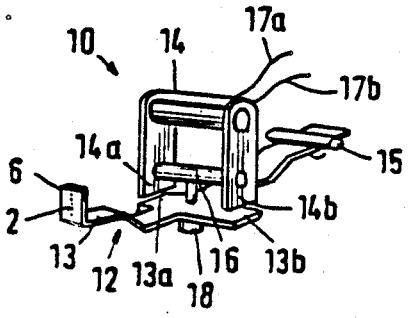

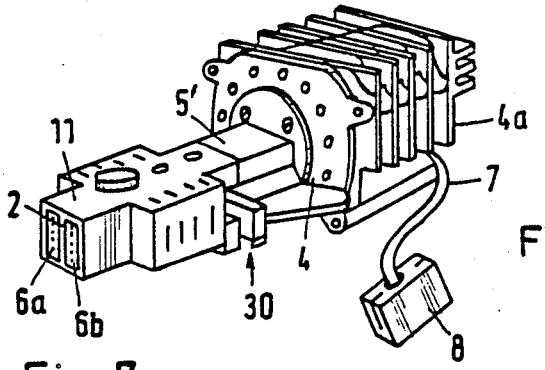
Fig.7
Fig.7a
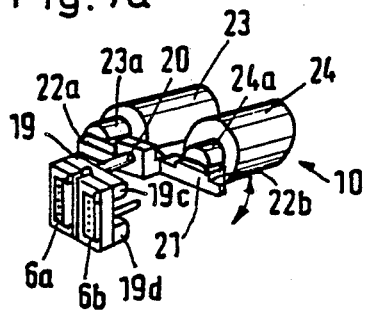
Fig.8
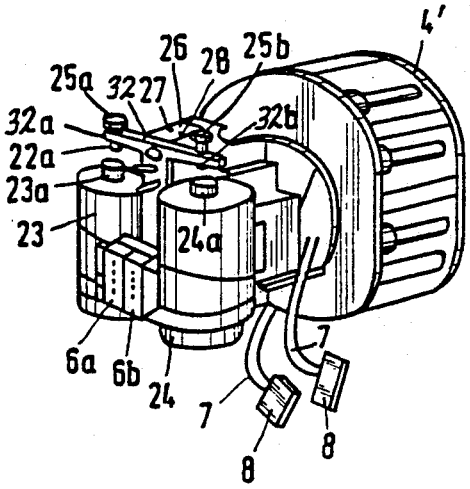
Fig.9
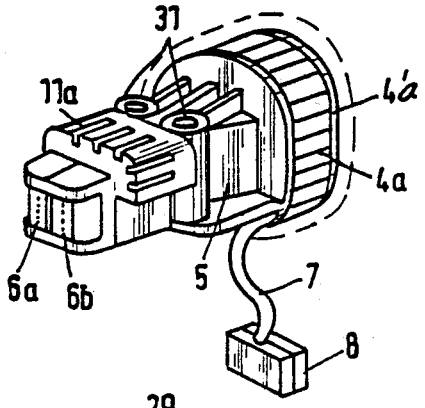
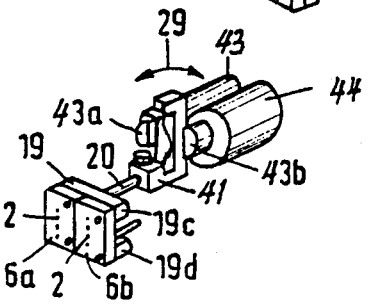
Fig. 9a

SHIFTABLE GUIDE FOR A MATRIX PRINTHEAD

This is a continuation of application Ser. No. 107,888, filed on Oct. 13, 1987, now abandoned, which is a continuation of Ser. No. 317,130, filed Nov. 2, 1981, now abandoned.

BACKGROUND OF THE INVENTION

The present invention relates to a matrix printer which includes a needle- or stylus-type printhead movable across a surface to be printed on. The invention relates particularly to the operation and construction of such a printhead for selective high-speed and high-quality type printing.

Generally speaking, matrix printers of the pin, needle or stylus type are usually constructed either to operate as high-speed printers or to compose high-quality characters, but at a rather slow printing speed. U.S. Pat. No. 4,159,882 proposes the vertical displacement of paper for obtaining high-quality printing in different passes. U.S. Pat. No. 4,010,835 proposes the use of two columns of styli, one being stationary on the head, the other one being displaceable. This printer can be used in two modes: low quality/high speed or high quality/low speed. High-speed operation finds respective two styli of the two columns horizontally aligned; high-quality operation is carried out in a staggered arrangement of the two columns so that, e.g., each vertical line is printed twice, once by each column but at a vertical displacement of the dots. However, one can readily see that this approach "beautifies" only vertical lines. Also, the paper advance is not matched to this type of operation.

DESCRIPTION OF THE INVENTION

It is an object of the present invention to provide a new and improved arrangement for selective dot matrix printing in a fast- or high-speed mode and in a high-quality mode. Moreover, the printer is to be constructed so that its operation does not depend upon paper displacements at as small as half a dot-to-dot (or stylus-to-stylus) distance.

It is a specific object of the present invention to improve dot matrix printers having at least one vertically displaceable column of styli.

In accordance with the preferred embodiment of the invention, it is suggested to operate such a printer in a high-quality mode using stylus column displacement for composing a character in such a manner that the resolution of print positions in the direction of printing is higher than in the high-speed mode (not using vertical column displacement), whereby the raster division in vertical and horizontal directions is not more than approximately 0.4:1 (or 1:2.5). This way, dot printing is carried out with overlapping dots not only in the vertical but also in the horizontal and, inherently, in any oblique direction, in character curves, etc. Paper advance can be carried out exclusively outside any print pass and is entirely independent from the mode of printing. The paper is, thus, held firmly throughout any print pass. The raster division for purposes of obtaining and operating with different print matrices during the different modes preferably uses two different character generators (ROM's) together with two different print position clocks, one for fine resolution and one (high speed) for regular resolution.

A matrix printhead is usually constructed in that the front portion is occupied by the mouthpiece, arranging the styli in columns, and in the rear the various (comparatively bulky) drives are clustered. The styli run from this drive cluster to the mouthpiece. The guide structure for that purpose does not occupy excessive space. Therefore, one may arrange in this zone or area one or more drives for shifting the mouthpiece(s), using a transfer member (lever arm, swivel rocker, pointer-like arm).

The invention can be practiced in a single mouthpiece version, holding one column of stylus tips and being mounted at the end of an electromagnetically pivoted arm, for purposes of assuming one or the other of two vertically displaced positions. The high-quality speed operation is carried out in two directions, with a vertical shift having occurred at the end of one of the two passes, and each pass operates with a finer resolution of print positions per character than a dot-to-dot spacing. The high-speed operation is a single-pass, fixed mouthpiece position operator at a much coarser horizontal resolution, wider dot spacing.

In a two-mouthpiece version, the two mouthpieces each hold, e.g., 9 stylus tips thus arranged in two columns. The two mouthpieces are vertically displaceable, preferably by means of two electromagnetic drives coupled via a common member to the two mouthpieces in a four-point (two pairs) connection resembling a parallelogram whose corner angle is changed.

Alternatively (to the electromagnetic drives), one may use an adjusting spindle which, upon turning, shifts the above-defined parallelogram connection. The spindle may bidirectionally driven by a small servomotor and extends basically in the direction of the styli. Instead of a servomotor, a crank may be affixed to the spindle which is pivoted by an electromagnet whose armature is articulated to the spindle. The crank may be spring-biased to obtain turning of the spindle upon de-energization of the spindle-actuating magnet.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

FIG. 1 is a schematic view of a stylus column and of a 9-by-7 print matrix for high-speed dot printing;

FIG. 2 illustrates the same matrix but expanded for high-quality operation and corresponding, in effect, to a 18-by-28 matrix;

FIG. 3 is a perspective view of an example for a printhead constructed for practicing the preferred embodiment of the invention, in a rather simple example;

FIG. **3*a*** illustrates a basically similar printhead, but being slightly modified;

FIG. **3*b* illustrates a front portion of the head shown in FIG. 3**, the case having beem removed, the figure illustrating particularly a stylus column displacement mechanism.

Figure 4:
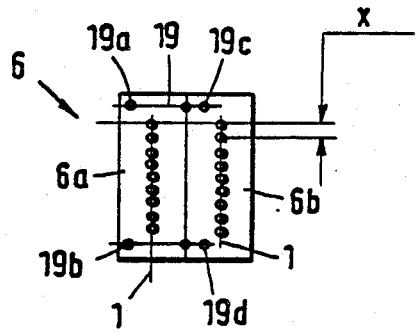
Figure 4A:
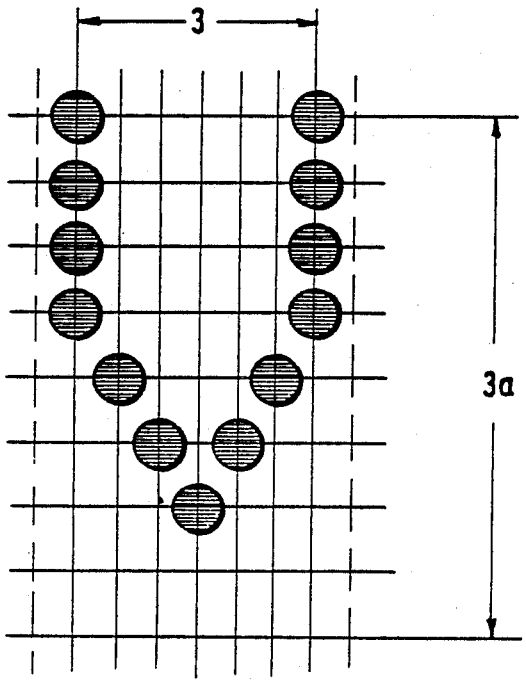

FIG. 4 illustrates a front view of the mouthpiece portion of a matrix printhead, having two vertically displaceable mouthpieces.

Figure 5:
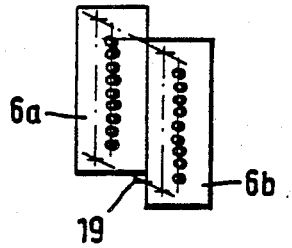
Figure 5A:
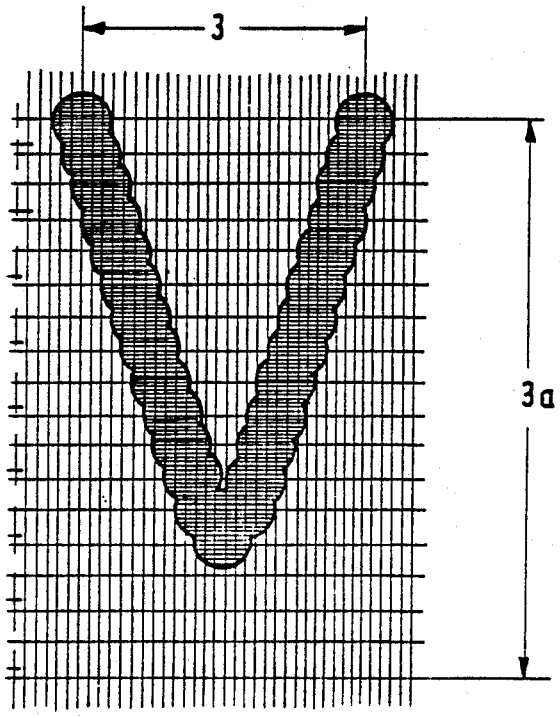

FIG. **4*a*** is a schematic view of the 9-by-7 matrix for a nine-stylus column for high-speed printing;

FIG. 5 is a view similar to FIG. 4, but with a relative displacement of the two columns;

FIG. 5*a* is a schematic view of an expanded 18-by-28 matrix, resulting from the displacement depicted in FIG. 5, for high-quality printing.

Figure 6:
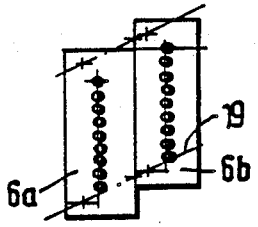
Figure 6A:
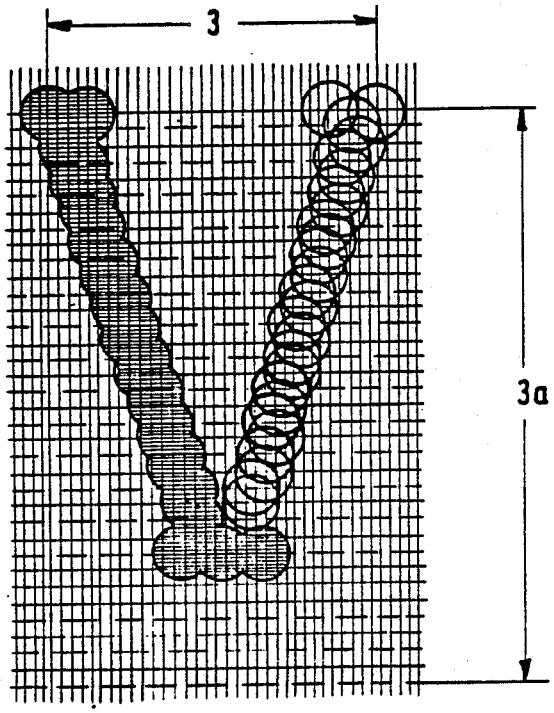

FIG. 6 shows the printhead as per FIG. 4, but for a 36-by-32 matrix;

FIG. 6*a* illustrates the companion 36-by-32 matrix;

FIG. 7 illustrates, in a perspective view, a printhead having two adjustable stylus columns;

FIG. 7*a* is a perspective view of the drive system for and in the printhead shown in FIG. 7 for displacing the two stylus columns;

FIG. 8 is a perspective view of a third example of the preferred embodiment, also having two vertically adjustable stylus columns, the case of the front portion having been removed.

FIG. 9 is a perspective view of a fourth example for arranging the drive for displacing two stylus columns relative to each other;

FIG. 9*a* is a perspective view of the particular drive system for column adjustment in the printhead shown in FIG. 9.

Proceeding now to the detailed description of the drawings, the FIGS. 1, 2, and 3 through 3*b* refer to a printhead in which print needles or styli 2 are arranged in a single column 1. There are nine such styli. Such a printhead is provided for "normally3[ printing a single character out of and in a field of a 9-by-7 dot matrix. That field has a width 3, measured from the right-most to the left-most print position and a maximum height 3*a*. This matrix (FIG. 1) defines the dot pattern for high-speed printing. The mouthpiece 6 for the printhead remains stationary in the high-speed or fast-print mode. Moreover, the vertical-to-horizontal raster division is, as is conventional, 9:7. However, one may wish to expand it slightly to a 9:11 situation, without incurring any loss in print speed.

The high-speed print matrix shown in FIG. 1 has been modified in two ways to obtain a high-quality matrix of FIG. 2. First, column 1 is used in two different vertical positions; these positions differ by half the dot-to-dot spacing (X) in the column. Second, the horizontal print position pattern is considerably finer divided, in 29 positions (the additional position does result from an overall area size expansion of the print position and dot matrix). One may provide for a still finer division in order to obtain a, say, 18-by-40 matrix or 36-by-40 or 36-by-32 matrices.

Turning next to structural particulars, the printhead of FIGS. 3, 3*a*, and 3*b* includes a frame 4 serving also as a case for the magnetic drive elements (e.g., solenoids) of the print styli 2. These styli run through a guide and support structure 5 toward the mouthpiece 6. Only the front-end tip of each stylus is visible in the front face of the mouthpiece.

Electric current is fed to each of the magnetic drives (there being as many as there are styli) via a cable 7; reference number 8 refers to a suitable plug. As indicated schematically, stylus drive signals are applied to that plug from the external control which includes stylus drive control 50, receiving signals either from a low-resolution-type character generator 51 or from a high-resolution-type character generator 52. The selection may be under control of a suitably programmed microprocessor. The latter is, in addition, under the control of a forward- and reverse-select circuit because a different portion of each character pattern is selected for forward and for reverse high-quality printing; the two printings are carried out at different, vertical positions of the mouthpiece 6, and each character is composed of two patterns, one being used to print the portion of a character when the mouthpiece 6 is in the lower position, the other one being used when the mouthpiece is in the upper position. For both instances, the print direction is different. In the high-speed mode (low, horizontal resolution), a different clock is used because, as explained above, the horizontal raster for print stop positions is different in the different modes and speeds of printing. This selection may also be controlled by a microprocessor.

The mouthpiece 6 and equipment directly in the rear thereof are contained in a cover 9; that equipment includes particularly the drive 10 for mouthpiece 6. Cover 9, however, does not restrain mouthpiece 6, the latter is vertically displaceable.

FIG. 3*a* illustrates a modified cover 9′, containing also an ink ribbon guide. This is not essential, however. Of considerable importance is the fact that the rear portion of cover 91 is somewhat enlarged and contains the suspension and drive mechanism for the mouthpiece. Generally speaking, this drive mechanism is situated between the front of the printhead (mouthpiece 6) and the cluster of stylus drives inside rear case 4. Reference numeral 30 refers to suitable fastening lugs, bores, or the like, for fastening this printhead to a carriage by means of which the printhead is moved past the paper during print passes. The vertical mouthpiece drive 10 includes a lever structure 12 including, in turn, a front arm 13 to which mouthpiece 6 is mounted in an upright position. Arm 13 has lateral extensions 13*a* and 13*b* which function as pole surfaces or armature ends, respectively facing magnetic poles 14*a* and 14*b* of an electromagnet. Arm 13 is made of a resilient material, and lever structure 12 as a whole is pivotable about an axis or pin 15. The pole pieces 14*a* and 14*b* are mounted to each other by a traverse 16 there being a coil in the upper portion of magnetic structure 14; that coil 17 is electrically connected to a suitable source of voltage potential by means of the leads 17*a* and 17*b*.

Upon energizing the coil 17, the magnet 14 lifts arm 13 up until the lugs 13*a* and 13*b* respectively abut the down-facing end faces of pole pieces 14*a* and 14*b*. The mouthpiece 6 is lifted accordingly. The down position of the arm 13 is determined by an adjusting screw 18 against whose head arm 13 can abut. The pieces 14*a* and 14*b* can be constructed as permanent magnets, and energization of coil 17 may cancel the field. In this case, arm 13 will be lifted up when the coil 17 is not energized.

For high-speed-low-resolution operation, mouthpiece 6 is retained in a particular position; for example, without energization of the drive 10. The low-resolution character generator 51 is used. The clock pulses used originate from a high-resolution clock 53 commensurate with the horizontal raster, defining, e.g., several possible horizontal print positions for any character. The mode-select circuit applies these clock pulses to the stylus drive control 50 which will cooperate, in this instance, with the low-resolution character generator.

A mouthpiece-lifting (or lowering) operation takes place when the printer is to produce a high-quality print. In this case, characters are first printed on a line and in a first, relatively high, speed pass. However, the resolution of the raster in horizontal direction has been increased over the regular high-speed print operation. The high-quality print requires more print positions.

Nevertheless, the characters are not completely printed in one pass; they are "completed" on a reverse pass. Accordingly, a high-resolution clock 54 is used for this instance, yielding a larger number of possible print positions per character (e.g., 28 or 40). The particular line is printed again in the reverse pass; but prior to this second pass, mouthpiece 6 has been lifted to an upper position as described, the lifting stroke X/2 being approximately one-half of a dot width (or one-half of a vertical stylus tip-to-stylus tip center spacing). The same field, originally a 9×7 matrix, therefore, is now expanded to a 18×28 (+1) matrix (FIG. 2). However, as stated earlier, one may well divide the field into a still finer raster, such as an 18×40 or even a 36×40 matrix. This is particularly suitable when the print dots are spaced vertically due to stylus spacing in the head mouthpiece 6.

It should be mentioned that the high- and low-resolution clocks may share components. For example, the high-resolution clock 54 may derive its clock signal from a suitable, slotted disk, or the like, that runs with the carriage and its drive moving the printhead across the paper. The low-resolution clock 53 may, for instance, select only some of the high-resolution clock pulses and suppress the others.

FIG. 4 illustrates a split mouthpiece, 6*a* and 6*b*, each with a column of styli. The number of styli is, thus, doubled. Reference numerals 19*a*, 19*b*, 19*c*, and 19*d* refer to the ends or corners of a linking parallelogram 19. The pivot axis for this linkage is situated between the two mouthpieces 6*a* and 6*b* which are basically independently movable in vertical directions, but the linkage 19 ties them together. This linkage 19 is turned (i.e., the angle of the quadrilateral it forms is changed) on that axis by a pin 20 (see FIG. 7*a*), the axis extends transversely to the plane of printing. Upon turning of pin 20, the corner points 19*a* to 19*d* of the parallelogram undergo a displacement having a slight curvature. This, however, is so small that it will not be noticed.

FIG. 4 illustrates the position of the mouthpieces for high-speed operation, in which both columns participate so that the speed of printing is about doubled as compared with the high-speed operation as per FIG. 3. The pieces 6*a* and 6*b* are positioned so that the styli in the two columns are horizontally aligned in pairs. This way, each column can work on the same matrix.

FIG. 5 illustrates the two pieces in a mutually displaced position. The displacement is grossly exaggerated. In fact, each piece was shifted by the small spacing X/4, but in opposite directions resulting in a summary displacement by X/2. The high-quality print can, thus, be obtained in a single pass, and upon selecting a more detailed pattern of horizontal print positions, one may obtain an 18 by 28 print matrix. FIG. 5*a* illustrates such a high-resolution print matrix in which the number of vertical positions has been doubled on account of the fact that eighteen styli are available. Moreover, the horizontal resolution has been quadrupled as compared with the high-speed operational mode.

FIG. 6 illustrates a further refinement, in that by means of two displacements, one being $\frac{1}{4}$ X and one $\frac{3}{4}$ X (each piece being respectively displaced in opposite directions by $\frac{1}{8}$ X and $\frac{3}{8}$ X) a 28 by 36 matrix is produced. In other words, the resolution in vertical direction is doubled. This, of course, requires also a two-pass per character and line. Nevertheless, the print quality is further improved, to the point that individual dots or dot boundaries are no longer noticeable.

FIG. 7 illustrates a printhead for a two-mouthpiece version. The housing 4*a* in this case is provided with cooling fins and contains all of the drives for the eighteen styli. Part 5' is the guide structure for these styli, and it is the cover particularly for the tilt/pivot drive 10' for the two mouthpieces 6*a*, 6*b*. The case 11 is provided with cooling slots.

This tilt drive 10' includes two solenoids 23 and 24 having cores constituting two pole pieces 23*a* and 24*a*. Each solenoid has a coil, and together with respective core constitute a coil/core arrangement. Each coil has an axis around which the coil loops and as is conventional appropriate magnetic poles develop along that axis at opposite ends of the respective coil. These cores are not fully cylindrical but have downwardly oriented pole faces. These two poles cooperate with a swivel armature 21 for turning the pin 20. The neutral position of this drive finds the arm 21, e.g., in a $\frac{1}{4}$ X displacement position, energizing one drive causes the arm 21 to be horizontal, energizing the other drive may produce the $\frac{3}{4}$ X displacement. The drives 23, 24 are mounted to Frame 4*a*, armature 21 has pole ends 22*a* and 22*b*.

FIG. 8 illustrates a modified head arrangement but being constructed for the same purpose, namely, permitting vertical displacement of mouthpieces 6*a*, 6*b*. The frame 4' in this case holds again the eighteen stylus drives. The two magnetic drives 23' and 24' are arranged with magnetic axes parallel to the plane of printing and more or less to both sides (a little to the rear) of the two mouthpieces 6*a*, 6*b*. The pole pieces 23'*a* and 24'*b* cooperate with portions 32*a* and 32*b* of a rocking or swivel lever 32. Adjusting screws 25*a*, 25*b* in the ends of lever 32 adjust the swivel stroke of the lever. These screws may have screw-driver slots for purposes of a simple adjustment by means of a screwdriver. The screws are, thus, similar to adjustment spindles. The turning motion of that lever 32 is again transferred upon the pin 20 operating the parallelogram part 19 suspending the two pieces 6*a*, 6*b*. Particularly, rocking lever 32 has a nose 26 and tension members 27 and 28 tie that nose to the pin 20 for causing the parallelogram to shift the pieces 6*a*, 6*b*.

FIGS. 9 and 9*a* illustrate another contour for the case or housing, 4'*a*, for the stylus drives. Cover 11*a* for the front part is provided here with cooling slots. The construction of these parts is, basically, as afore-described. The two magnetic drives 43 and 44 are placed here somewhat closer to each other than in FIG. 7*a*, and the cores 43*a* and 44*b* have vertically oriented, flat sides facing each other. Each solenoid has a coil, and together with the respective core constitute a coil/core arrangement. Each coil has an axis around which the coil loops and as is conventional appropriate magnetic poles develop along that axis at opposite ends of the respective coil. The shaft 20 carries an armature 41 which extends at right angles to the shaft, between the two cores 43*a*, 43*b*, resembling a printer; connecting arm 42 extends from armature 41 to shaft 20, the latter in turn extends towards and holds the frame 19 which in turn provides mouthpiece displacement as described. Depending upon the energization, either drive 43 or drive 44 attracts that armature 41 and, thereby, shifts the mouthpieces 6*a*, 6*b* in one or the other direction.

I claim:

1. Matrix print head, having a case containing a plurality of print styli drives, there being a plurality of print styli extending through said case and from the respective drives therein, through a mouthpiece at an end of the case, to be positioned adjacent a printing platen, the head provided for movement along the platen the improvement comprising:

said mouthpiece being movable within said case in a direction transverse to an extension of the styli;

a print styli and mouthpiece adjusting device in said case, including an electromagnet drive inside said case, said drive including a magnetic coil wound around a core to establish a coil/core configuration, said configuration having a longitudinal axis around which the coil extends, opposite magnetic poles developing at opposite ends of said configuration being spaced along said axis said axis extending along said print styli but being laterally offset with respect to said print styli; and said electromagnet drive having an actuation end coupled to said mouthpiece for adjusting the position of a mouthpiece in said direction being also transversely to a direction of movement of said matrix print head and to the extension of said axis of said drive.

2. Matrix print head having a case, a plurality of print styli drives included in the case, there being a plurality of print styli extending through said case and from said respective drive therein, through a mouthpiece at an end of the case such that ends of the styli are positioned adjacent a printing platen, the print head being provided for movement along said platen, the improvement comprising:

said mouthpiece being movable within said case transversely to the extension of the styli;

a magnetizable core coil arrangement in said case and having an axis such that the coil of said arrangement loops around the axis, opposite magnetic poles develop at opposite ends of the coil/core arrangement along said axis, said coil/core arrangement being mounted so that said axis extends along said styli and essentially parallely to said styli;

a pivotable armature mounted for pivoting at one end of said coil; and an arm on the armature extending towards said platen, said mouthpiece being mounted to said arm.

3. Matrix print head having a case, a plurality of print styli drives included in the case, there being a plurality of print styli extending through said case and from said respective drive therein, through a mouthpiece at an end of the case such that ends of the styli are positioned adjacent a printing platen, the print head being provided for movement along said platen, the improvement comprising:

a magnetic core coil arrangement in said case and having a longitudinal axis in that the coil loops around that axis, the axis being arranged to extend along said styli and essentially parallely to said styli;

an armature electromagnetically cooperating with said coil/core arrangement and mounted for pivoting upon energization of the coil;

an arm connected to the armature and having a free end extending towards said platen; and said mouthpiece mounted to said free end of said arm, and thus being movable within said case transversely to the extension of the styli.

4. Matrix print head, having a case containing a plurality of print styli drives, there being a plurality of print styli extending through said case and from the respective drives therein, through a mouthpiece at an end of the case, to be positioned adjacent a printing platen, the head provided for movement along the platen the improvement comprising:

said mouthpiece being movable within said case in a direction that extends transverse to an extension of the styli;

a print styli and mouthpiece adjusting device in said case, including an electromagnet drive inside said case, the drive including a coil/core arrangement having an axis around which the coil loops, the axis extending transversely to said direction of movement of the head; and said adjusting device further including actuation means connected to said mouthpiece for moving the position of the mouthpiece in a direction transversely to the direction of movement of said matrix print head and to the direction of said axis of said drive;

said actuation means further having armature means for cooperation with said coil/core arrangement to obtain said mouthpiece moving.

5. In a matrix printer having a printhead for a plurality of print styli and a corresponding plurality of drive elements for the styli, further having at least one mouthpiece receiving tips of the styli and arranging them in a vertical column, the improvement comprising:

means for mounting said mouthpiece including a deflecting arm that extends generally in the direction of the print styli and of styli-print movement and having the mouthpiece mounted on its front end, the arm being held in the rear;

electromagnetic means disposed at a location between the rear of the arm and its front end for causing the arm to deflect such that the mouthpiece is shifted in a vertical direction by half a spacing between adjacent styli tips such that dots are printed in overlapping tip configurations when the same vertical character line is printed in an original mouthpiece position and in a shifted position;

the electromagnetic means including a magnet with two poles arranged on opposite sides of the arm, the arm having two extensions serving as armature ends cooperating with said two poles; and means for operating the printer to print character lines with the same styli twice, once in a particular position of said arm and mouthpiece and once in a displaced position.

* * * * *